US009026005B2

(12) United States Patent
Mogi

(10) Patent No.: US 9,026,005 B2
(45) Date of Patent: May 5, 2015

(54) IMAGE FORMING APPARATUS

(71) Applicant: Mariko Mogi, Nagoya (JP)

(72) Inventor: Mariko Mogi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/940,310

(22) Filed: Jul. 12, 2013

(65) Prior Publication Data

US 2014/0029978 A1 Jan. 30, 2014

(30) Foreign Application Priority Data

Jul. 27, 2012 (JP) ..... 2012-166989

(51) Int. Cl.
*G03G 21/16* (2006.01)

(52) U.S. Cl.
CPC .... *G03G 21/1619* (2013.01); *G03G 2215/0141* (2013.01)

(58) Field of Classification Search
USPC ..... 399/125, 401
See application file for complete search history.

(56) References Cited

U.S. PATENT DOCUMENTS

| | | | | |
|---|---|---|---|---|
| 4,180,319 | A * | 12/1979 | Kaufmann et al. | 399/124 |
| 6,016,409 | A * | 1/2000 | Beard et al. | 399/33 |
| 7,706,716 | B2 | 4/2010 | Tada et al. | |
| 8,055,181 | B2 * | 11/2011 | Murayama | 399/401 |
| 8,781,363 | B2 * | 7/2014 | Ishikuro | 399/121 |
| 2008/0075502 | A1 | 3/2008 | Tada et al. | |
| 2009/0226212 | A1 * | 9/2009 | Hayakawa | 399/124 |
| 2011/0262201 | A1 * | 10/2011 | Souda | 399/401 |
| 2011/0280617 | A1 * | 11/2011 | Iino et al. | 399/110 |

FOREIGN PATENT DOCUMENTS

| | | | |
|---|---|---|---|
| JP | 04-258968 | A | 9/1992 |
| JP | 2008-065122 | A | 3/2008 |

* cited by examiner

*Primary Examiner* — Clayton E Laballe
*Assistant Examiner* — Leon W Rhodes, Jr.
(74) *Attorney, Agent, or Firm* — Banner & Witcoff, Ltd.

(57) ABSTRACT

An image forming apparatus is provided, which includes a sheet tray disposed to face a plurality of photoconductive bodies across a belt device, and two main frames disposed to face each other across the plurality of photoconductive bodies, the belt device, and the sheet tray, the two main frames being configured such that the plurality of photoconductive bodies, the belt device, and the sheet tray are detachably attached thereto, the two main frames being further configured to define a communication section that leads from a space for accommodating the plurality of photoconductive bodies to the sheet tray.

12 Claims, 12 Drawing Sheets

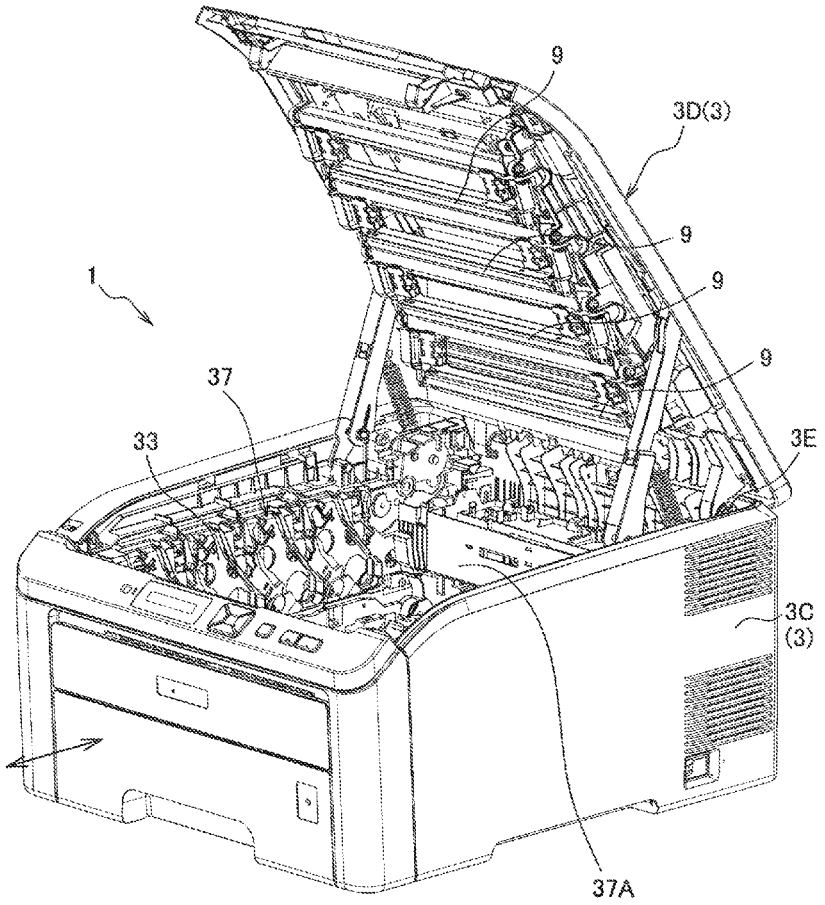
FIG. 3
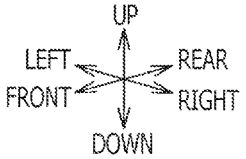

IMAGE FORMING APPARATUS

CROSS-REFERENCE TO RELATED APPLICATION

This application claims priority under 35 U.S.C. §119 from Japanese Patent Application No. 2012-166989 filed on Jul. 27, 2012. The entire subject matter of the application is incorporated herein by reference.

BACKGROUND

1. Technical Field

The following description relates to one or more techniques for an image forming apparatus configured to electrophotographically form an image on a sheet.

2. Related Art

An image forming apparatus has been known that employs a frame structure in which mutually-facing two side walls are connected with each other via a plate-shaped joint portion. In the known image forming apparatus, an endless belt (e.g., a transfer belt) and a plurality of photoconductive bodies are disposed above the plate-shaped joint portion. Further, under the plate-shaped joint portion, disposed is a sheet tray configured to receive placement of one or more sheets to be fed toward the endless belt.

Therefore, in the known image forming apparatus, even when the plurality of photoconductive bodies and the endless belt are removed from the apparatus, a space for accommodating the plurality of photoconductive bodies is completely separated from a space for accommodating the sheet tray by the plate-shaped joint portion.

SUMMARY

Aspects of the present invention are advantageous to provide one or more improved techniques to achieve an image forming apparatus having a new frame structure different from the known frame structure.

According to aspects of the present invention, an image forming apparatus is provided, which includes a plurality of photoconductive bodies arranged in tandem along a predetermined direction, each photoconductive body being configured to carry a developer image to be transferred onto a sheet, a belt device including an endless belt configured to move along a moving direction parallel to the predetermined direction, the belt device being disposed to face the plurality of photoconductive bodies, a sheet tray disposed to face the plurality of photoconductive bodies across the belt device, the sheet tray being configured to receive placement of the sheet to be fed to the endless belt, and two main frames disposed to face each other across the plurality of photoconductive bodies, the belt device, and the sheet tray, the two main frames being configured such that the plurality of photoconductive bodies, the belt device, and the sheet tray are detachably attached thereto, the two main frames being further configured to define a communication section that leads from a space for accommodating the plurality of photoconductive bodies to the sheet tray.

According to aspects of the present invention, further provided is an image forming apparatus that includes a plurality of photoconductive bodies arranged in tandem along a first direction, each photoconductive body being configured to carry a developer image to be transferred onto a sheet, a belt device including an endless belt configured to move along the first direction, the belt device being disposed to face the plurality of photoconductive bodies, a sheet tray disposed to face the plurality of photoconductive bodies across the belt device in a second direction perpendicular to the first direction, the sheet tray being configured to receive placement of one or more sheets to be fed to the endless belt, and two main frames disposed to face each other across the plurality of photoconductive bodies, the belt device, and the sheet tray in a third direction perpendicular to the first direction and the second direction, the two main frames being configured to allow the plurality of photoconductive bodies, the belt device, and the sheet tray to be attached to and detached from the two main frames, the two main frames defining therebetween a communication section configured to, when the plurality of photoconductive bodies and the belt device are detached from the two main frames, allow a space for accommodating the plurality of photoconductive bodies to communicate with the sheet tray, so as to permit an external access to the sheet tray via the communication section.

BRIEF DESCRIPTION OF THE ACCOMPANYING DRAWINGS

FIG. 3 is a perspective view showing the image forming apparatus in a state where an upper cover is open in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described in detail with reference to the accompanying drawings. The embodiment will provide an example in which aspects of the present invention are applied to an image forming apparatus configured to electrophotographically perform color printing.

1. Overall Configuration of Image Forming Apparatus

Figure 1:
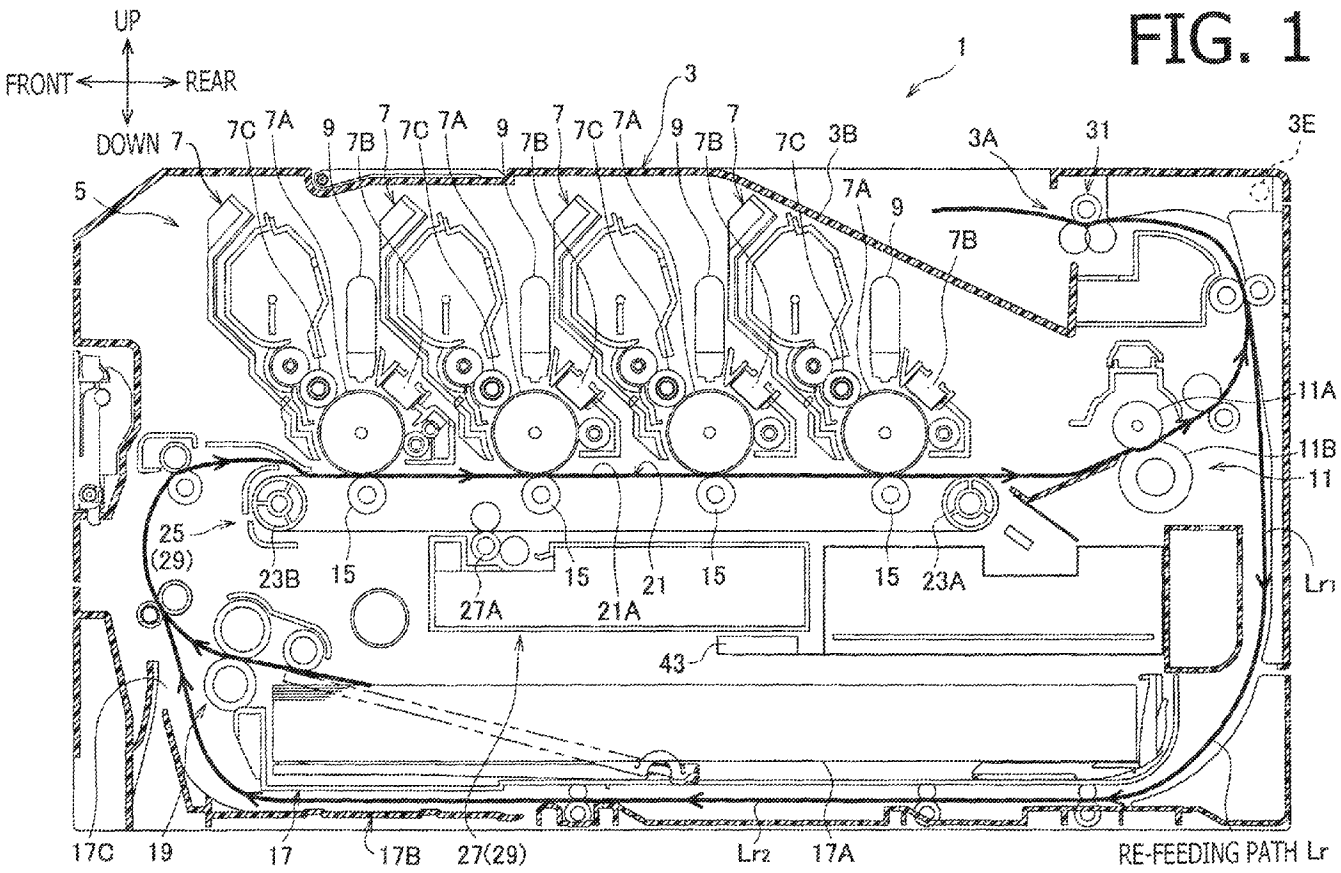
FIG. 1 is a cross-sectional side view schematically showing an internal configuration of an image forming apparatus in an embodiment according to one or more aspects of the present invention.

As shown in FIG. 1, an image forming apparatus 1 has a housing 3, which accommodates an image forming unit 5 configured to form an image on a sheet (such as a recording paper) in an electrophotographic method to transfer a developer image onto the sheet. The image forming unit 5 includes a plurality of process units 7, a plurality of exposure units 9, and a fuser unit 11.

The image forming unit 5 is of a direct tandem type in which the plurality of process units 7 (in the embodiment, four process units 7) are arranged in tandem along a sheet conveyance direction.

The process units 7, except for storing therein respective different colors of development agent, have substantially the same configuration. Specifically, each process unit 7 includes a photoconductive drum 7A configured to hold and carry a developer image, a charger 7B configured to charge the photoconductive drum 7A, and a development roller 7C configured to supply development agent to the photoconductive drum 7A.

Thereby, the charged photoconductive drum 7A is exposed by an exposure unit 9 to form an electrostatic latent image on a surface of the photoconductive drum 7A. Then, when the development agent is supplied to the surface of the photoconductive drum 7A having the electrostatic latent image formed thereon, the developer image to be transferred onto a sheet is formed on the surface of the photoconductive drum 7A.

In the embodiment, each exposure unit 9 includes a plurality of light emitting elements arranged in parallel with an axial direction of the photoconductive drum 7A. Therefore, a plurality of exposure units 9 are provided for the plurality of photoconductive drums 7A, respectively. It is noted that, in the embodiment, LEDs are employed as the light emitting elements.

Further, there are transfer portions 15 disposed to face the photoconductive drums 7A across an upside-extending surface 21A of a transfer belt 21. Each transfer portion 15 is configured to transfer onto the sheet the developer image carried on a corresponding one of the photoconductive drums 7A. The developer images carried on the photoconductive drums 7A are sequentially transferred onto the sheet being conveyed on the transfer belt 21 in a superimposed manner.

The transfer belt 21 is an endless belt moving along a direction along which the photoconductive drums 7A are arranged. The transfer belt 21 is wound around at least two rollers including a driving roller 23A and a driven roller 23B, so as to be stretched tight. It is noted that the upside-extending surface 21A is one surface, which faces the photoconductive drums 7A, of two extending planer surfaces of the transfer belt 21 wound around the driving roller 23A and the driven roller 23B.

The transfer belt 21, the driving roller 23A, the driven roller 23B, and a frame (not shown) supporting the driving roller 23A and the driven roller 23B are unitized as a single module. Hereinafter, the single module will be referred to as a belt unit 25.

The fuser unit 11 is disposed on one side (in the embodiment, on a downstream side) in a moving direction of the upside-extending surface 21A. The fuser unit 11 includes a heating roller 11A configured to rotate and heat the developer image transferred onto the sheet, and a pressing roller 11B configured to press the sheet against the heating roller 11A.

Therefore, the developer image transferred onto the sheet is heated and thermally fixed onto the sheet by the fuser unit 11. The sheet ejected from the fuser unit 11 is ejected onto a catch tray 3B via an ejection unit 3A disposed at an upper portion of the housing 3, after a conveyance direction of the sheet is turned around substantially by 180 degrees.

In addition, there is a belt cleaner 27 disposed on an opposite side of the photoconductive drums 7A across the belt unit 25. The belt cleaner 27 is configured to clean up contamination adhering onto the transfer belt 21. The belt cleaner 27 includes a cleaning roller 27A configured to rotate in contact with a downside-extending surface, opposite to the upside-extending surface 21A, of the two extending planer surfaces of the transfer belt 21.

The belt unit 25 and the belt cleaner 27 are included in a belt device 29. The belt device 29 is disposed to face the plurality of photoconductive drums 7A.

There is a sheet tray 17 disposed on an opposite side of the photoconductive drums 7A across the belt device 29, i.e., under the belt device 29. The sheet tray 17 includes a loading portion 17A configured to receive a stack of sheets. The sheets placed on the loading portion 17A are fed toward the transfer belt 21 on a sheet-by-sheet basis by a feeding mechanism 19.

Further, in the embodiment, the image forming unit 1 has a double-side printing function to form images on both sides of a sheet. In execution of the double-side printing function, a sheet with an image completely formed on a first side thereof is re-fed to the image forming unit 5, such that another image is formed on a second side of the sheet.

Specifically, the ejection portion 3A includes an ejection roller 31 configured to switch its function between a function to eject the sheet conveyed from the fuser unit 11 onto the catch tray 3B and another function to turn around the conveyance direction of the sheet.

Further, in a single-side printing to form an image only on a first side of a sheet, the ejection roller 31 rotates to eject onto the catch tray 3B the sheet conveyed from the fuser unit 11 as it is. Therefore, the sheet with an image formed only on the first side thereof is placed on the catch tray 3B.

Meanwhile, in the double-side printing, a rotational direction of the ejection roller 31 is reversed after a lapse of a predetermined time period from a moment when a trailing end in the conveyance direction of a sheet with an image completely formed on a first side thereof gets separated from the fuser unit 11.

Therefore, the sheet of which the conveyance direction has been reversed is re-fed to the image forming unit 5 via a re-feeding path Lr. When image formation is completed on the second side of the sheet, the sheet is ejected from the ejection unit 3A onto the catch tray 3B without the conveyance direction of the sheet being turned around.

The re-feeding path Lr includes a first re-feeding path Lr1 extending from the ejection roller 31 to the sheet tray 17, and a second re-feeding path Lr2 extending to an entrance of the feeding mechanism 19 via a lower side of the loading portion 17A.

The second re-feeding path Lr2 includes a re-feeding unit 17B attached to a lower surface of the sheet tray 17 and a re-feeding path port 17C disposed on a side, close to the feeding mechanism 19, of the sheet tray 17. In other words, the sheet tray 17 is provided with a part of the re-feeding path Lr.

2. Configuration of Frame

Figure 2:
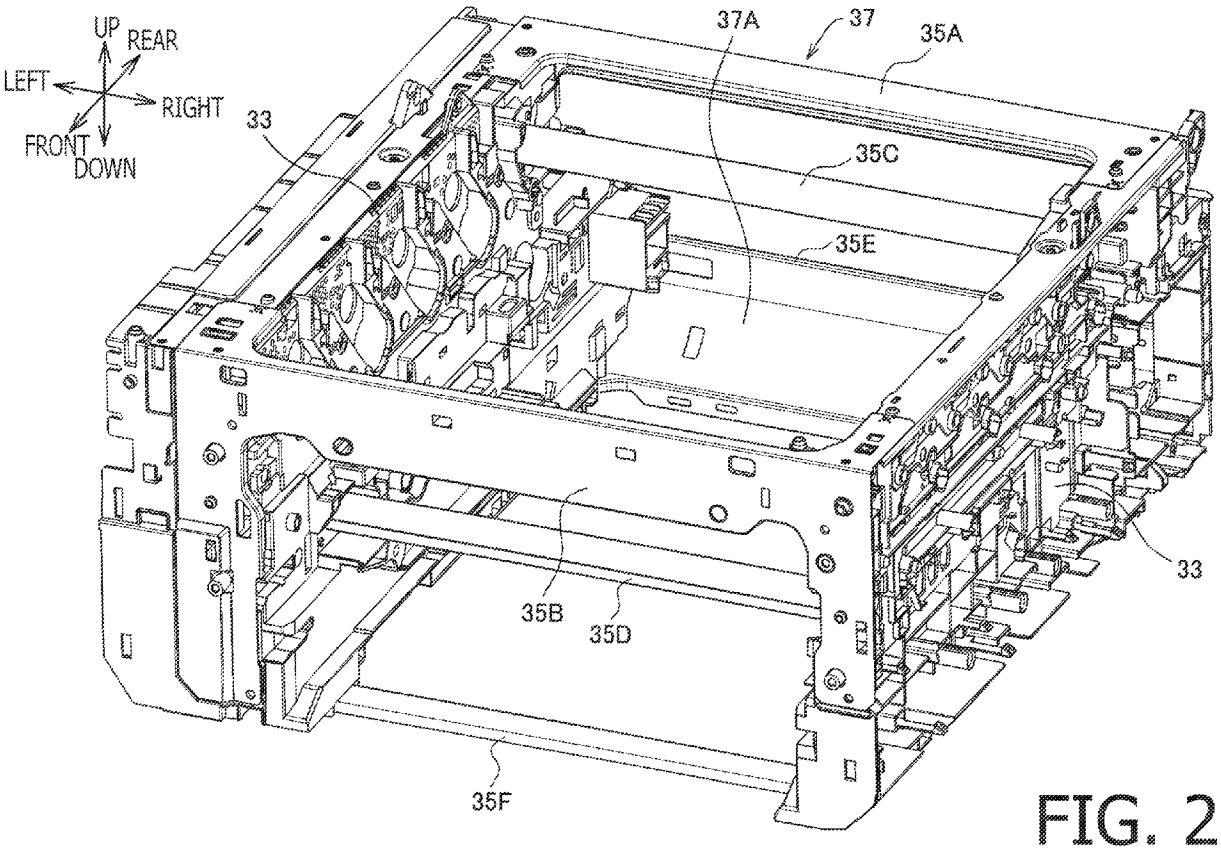
FIG. 2 is a perspective view showing a frame structure of the image forming apparatus in the embodiment according to one or more aspects of the present invention.

As shown in FIG. 2, two main frames 33, which are structural members of the image forming apparatus 1 in the embodiment, are disposed to face each other across a distance in a horizontal direction (a left-to-right direction in FIG. 2). Each main frame 33 is a substantially plate-shaped resin member, and is formed integrally with a plurality of reinforcing projections that protrude from a surface of the plate-shaped member (i.e., the main frame 33).

The two main frames 33 are connected by a plurality of sub frames 35A to 35F. The sub frames 35A to 35F are beam-shaped members each extending to bridge a distance between the two main frames 33, and are structural members configured to hold relative positional relationship between the two main frames 33.

In a space 37A secured between the two main frames 33, the image forming unit 5, the belt device 29, and the sheet tray 17 are disposed. Namely the two main frames 33 are disposed on respective different side in the left-to-right direction across the image forming unit 5, the belt device 29, and the sheet tray 17.

The sub frames 35A to 35F are made of metal. The sub frames 35A to 35F are tightly attached to the main frames 33 in a direct or indirect manner by a mechanical fastening method (e.g., by use of screws) (not shown). As shown in FIG. 3, a structural body 37, which includes the two main frames 33 and the sub frames 35A to 35F, is covered with side covers 3C and an upper cover 3D included in the housing 3.

The upper cover 3D is provided above the two main frames 33 so as to cover an upper side of the structural body 37. The upper cover 3D is swingably attached to the structural body 37 (in the embodiment, to the main frames 33) via a swing shaft 3E.

The swing shaft 3E is disposed on the downstream side, of an upper portion of the structural body 37, in the moving direction of the upside-extending surface 21A. Namely, the swing shaft 3E is disposed at an upper portion on a side, close to the fuser unit 11, of the structural body 37. Therefore, in the embodiment, the upper cover 3D is configured to swing around a swing axis disposed on a rear side of the image forming apparatus 1.

Further, the process units 7, the belt device 29, and the sheet tray 17 are detachably attached to the two main frames 33. Specifically, when the upper cover 3D is opened so as to open an upper side of the structural body 37, a user is allowed to attach/detach the process units 7, the belt device 29, and the sheet tray 17 to/from the two main frames 33.

Further, the belt unit 25 and the belt cleaner 27 are detachably attached to the two main frames 33 in a manner independent from one another. Specifically, when the upper side of the structural body 37 is opened, the plurality of exposure units 9 move upward together with the upper cover 3D, and the user is allowed to attach or detach the process units 7.

Figure 4:
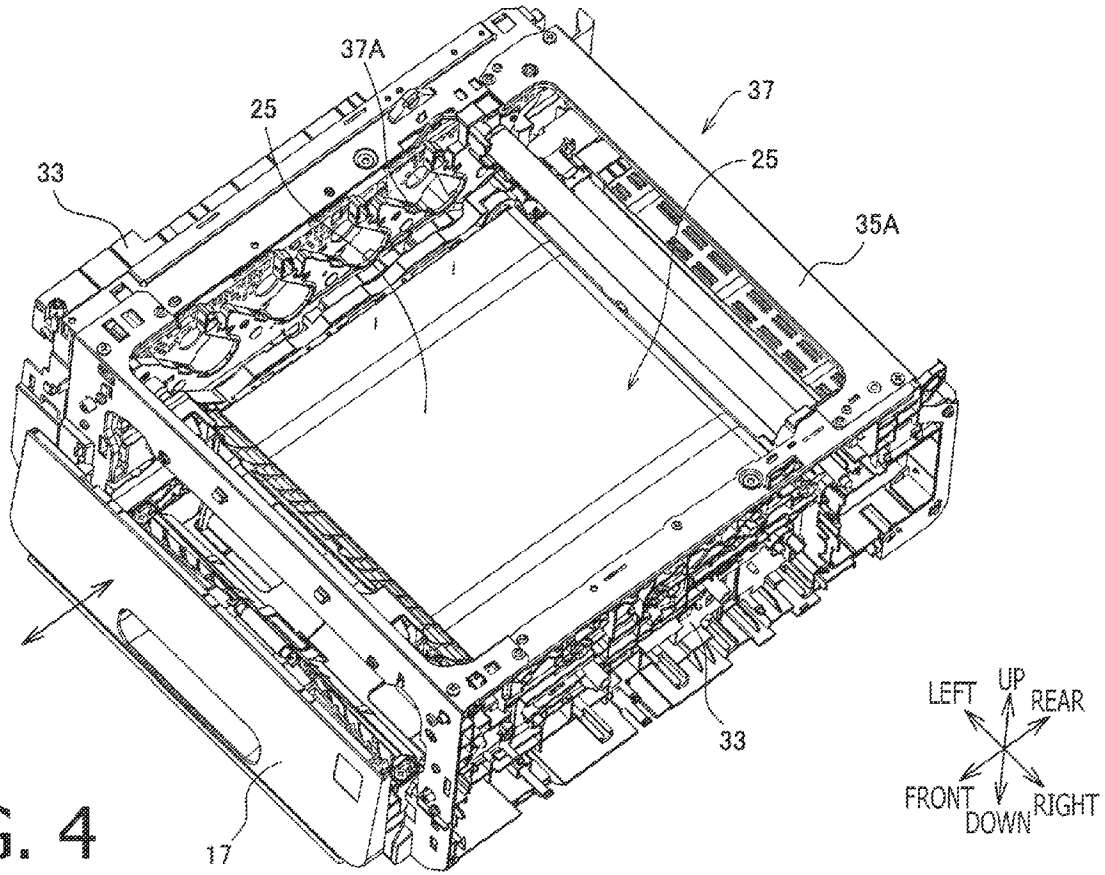
FIG. 4 is a perspective view showing a state where all process units are detached in a process to attach or detach the process units and a belt device in the embodiment according to one or more aspects of the present invention.
Figure 5:
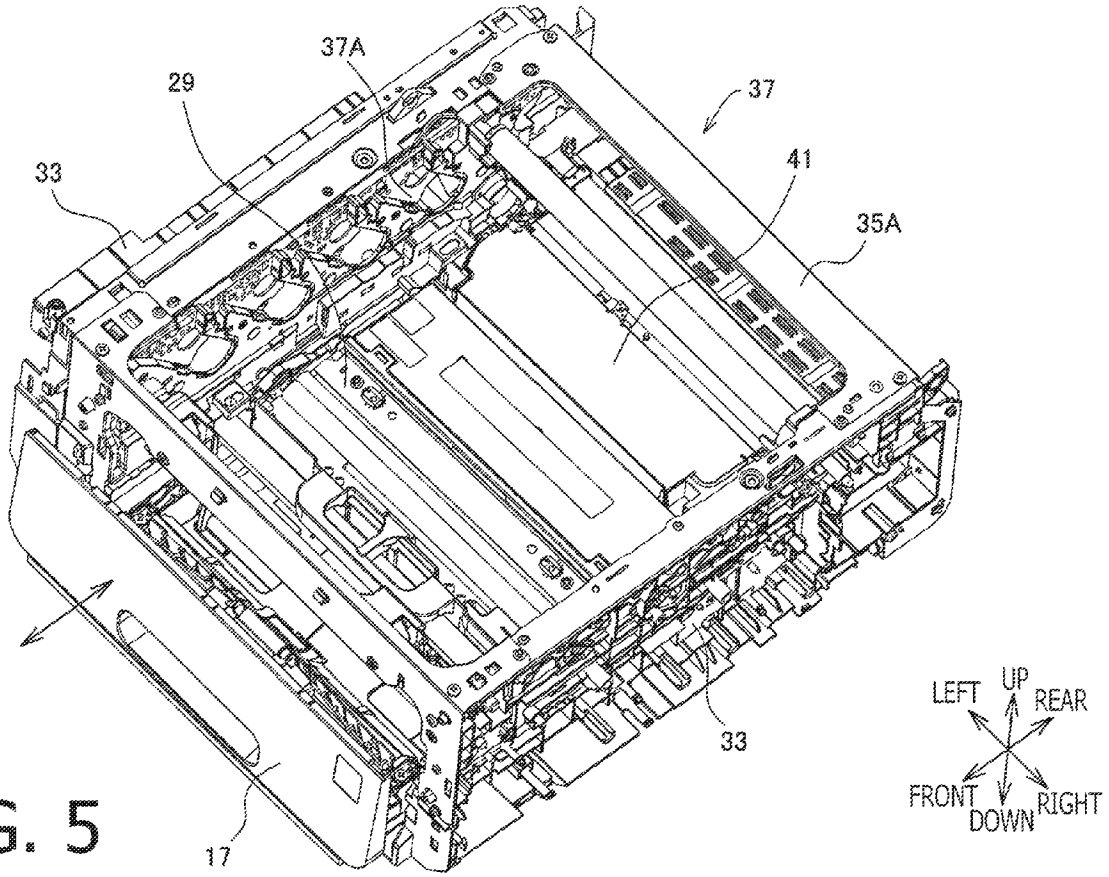
FIG. 5 is a perspective view showing a state where all the process units and a belt unit of the belt device are detached in the process to attach or detach the process units and the belt device in the embodiment according to one or more aspects of the present invention.

At this time, when all the process units 7 are detached by the user, as shown in FIG. 4, an upper side of the belt unit 25 is opened, and the user is allowed to attach or detach the belt unit 25. When the belt unit 25 is detached by the user, as shown in FIG. 5, an upper side of the belt cleaner 27 is opened such that the user is allowed to attach or detach the belt cleaner 27.

Figure 11:
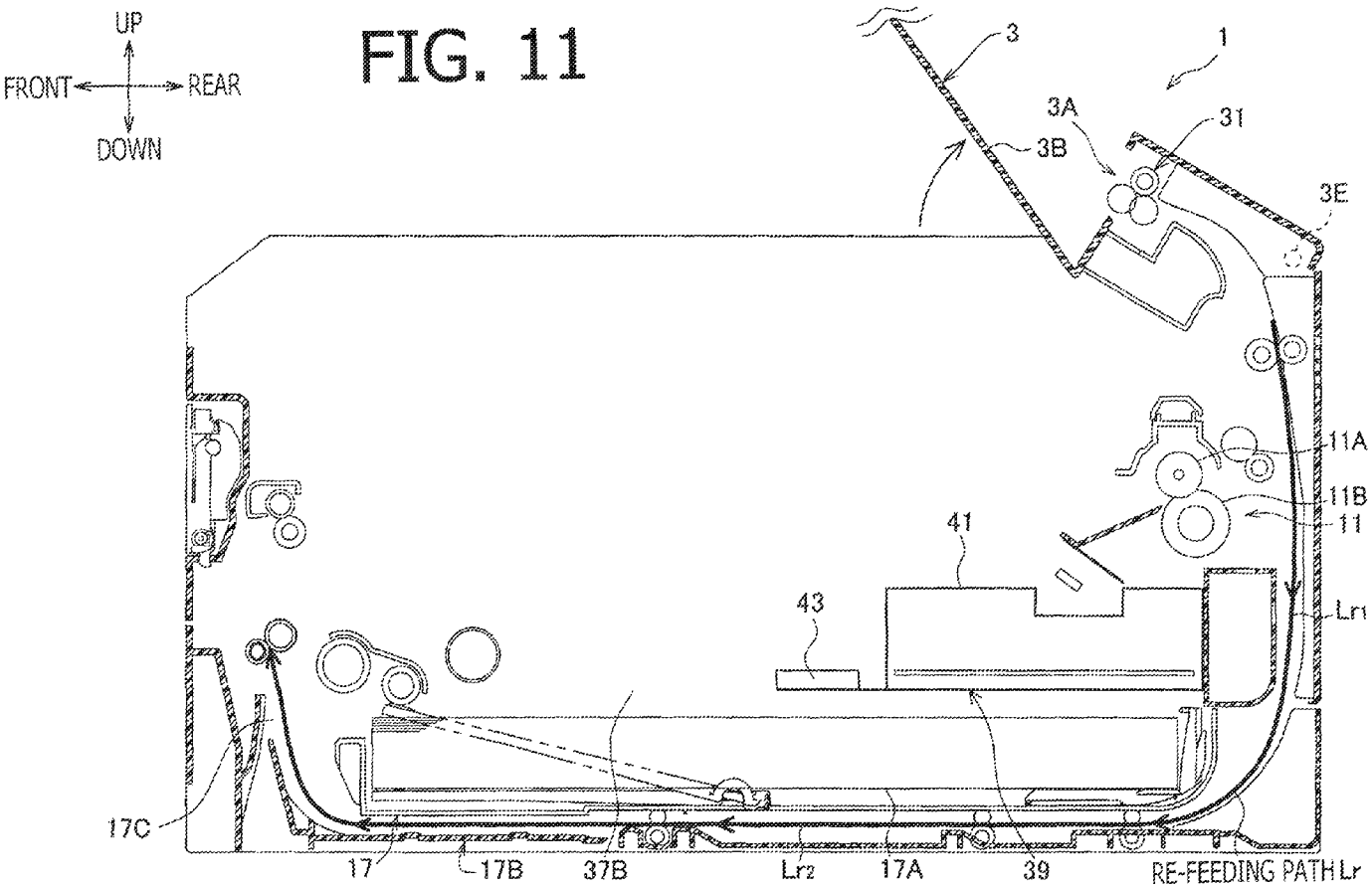
FIG. 11 is a cross-sectional side view schematically showing an internal configuration of the image forming apparatus in a state where all the process units and the belt device are detached therefrom in the embodiment according to one or more aspects of the present invention.

Then, when the belt cleaner 27 is detached by the user, as shown in FIG. 11, an upper side of the sheet tray 17 is opened. Therefore, in a state shown in FIG. 6 where the plurality of process units 7 and the belt device 29 are removed from the two main frames 33, the space for accommodating the plurality of process units 7 is allowed to communicate with the loading portion 17A via a communication section 37B hatched with diagonal lines.

Figure 6:
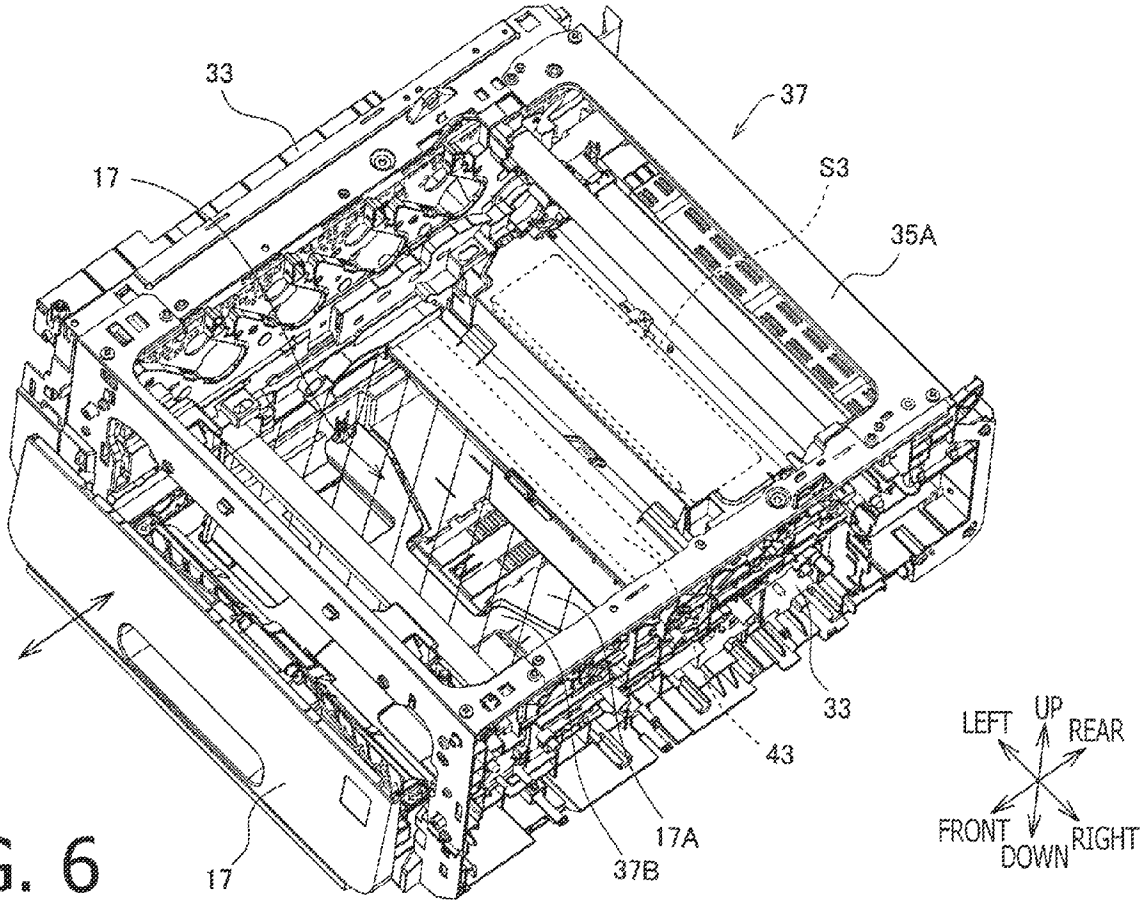
FIG. 6 is a perspective view showing a communication section in a state where all the process units and the belt device are detached in the process to attach or detach the process units and the belt device in the embodiment according to one or more aspects of the present invention.

Namely, the communication section 37B is a part of the space 37A defined between the two main frames 33, and is an opening section configured to allow the space for accommodating the plurality of process units 7 to communicate with the sheet tray 17. Therefore, as shown in FIGS. 5 and 6, the belt cleaner 27 is disposed in the communication section 37B.

Figure 12:
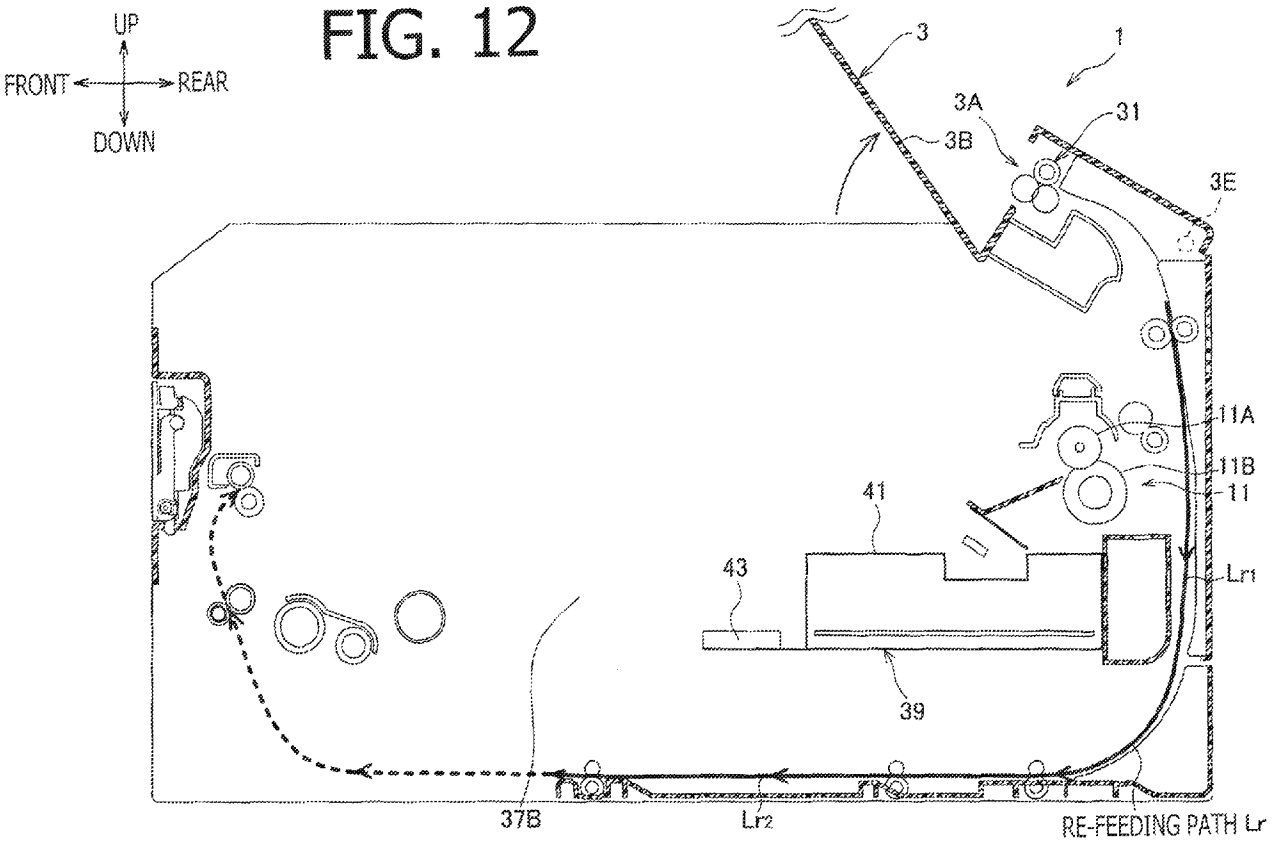
FIG. 12 is a cross-sectional side view schematically showing an internal configuration of the image forming apparatus in a state where all the process units, the belt device, and a sheet tray are detached therefrom in the embodiment according to one or more aspects of the present invention.

Further, the sheet tray 17 is attached to the two main frames 33 in a manner movable in a direction (in the embodiment, in a front-to-rear direction) parallel to the moving direction of the upside-extending surface 21A. Specifically, by moving (drawing) the sheet tray 17 frontward in the moving direction of the upside-extending surface 21A, the user is allowed to detach the sheet tray 17 from the two main frames 33. Then, in a state where the sheet tray 17 is removed from the two main frames 33, the re-feeding path Lr is partially exposed as shown in FIG. 12.

3. Electrical Boards and Wiring Structure

Figure 7:
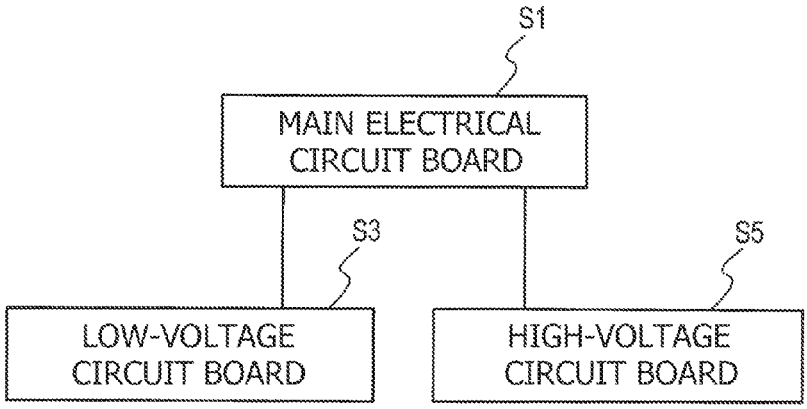
FIG. 7 is a block diagram showing an electrical configuration of electrical boards for the image forming apparatus in the embodiment according to one or more aspects of the present invention.

In the embodiment, as shown in FIG. 7, the image forming apparatus 1 includes electrical boards such as a main electrical circuit board S1, a low-voltage circuit board S3, and a high-voltage circuit board S5. The main electrical circuit board S1 is configured to control the entirety of the image forming apparatus 1 including the low-voltage circuit board S3 and the high-voltage circuit board S5.

The high-voltage circuit board S5 is configured to directly control devices (such as the charger 7B and the transfer portions 15) each driven at a high voltage. The low-voltage circuit board S3 is configured to directly control devices (such as a power supply circuit) each driven at a lower voltage than the driving voltages of the charger 7B and the transfer portions 15.

The main electrical circuit board S1 is attached to one (in the embodiment, to the left main frame 33) of the two main frames 33. The high-voltage electrical circuit board S5 is attached to the other one (in the embodiment, to the right main frame 33) of the two main frames 33.

Figure 8:
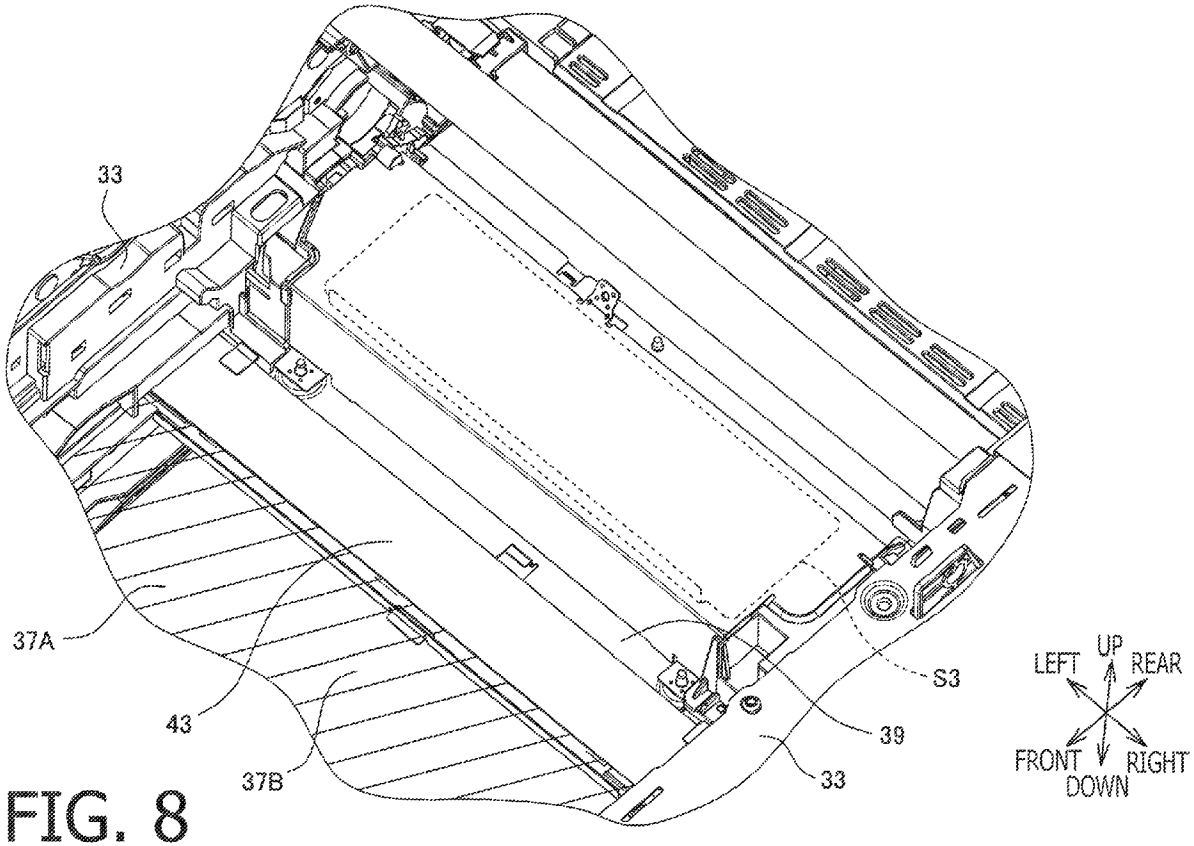
FIG. 8 is a perspective view showing a layout of elements such as an electric wiring unit and a low-voltage circuit board in the embodiment according to one or more aspects of the present invention.

The low-voltage circuit board S3 is, as shown in FIG. 6, disposed in the space 37A between the two main frames 33. Namely, as shown in FIG. 8, in a portion of the space 37A adjacent to the communication section 37B, a joint member 39 is disposed to connect the two main frames 33.

Figure 9:
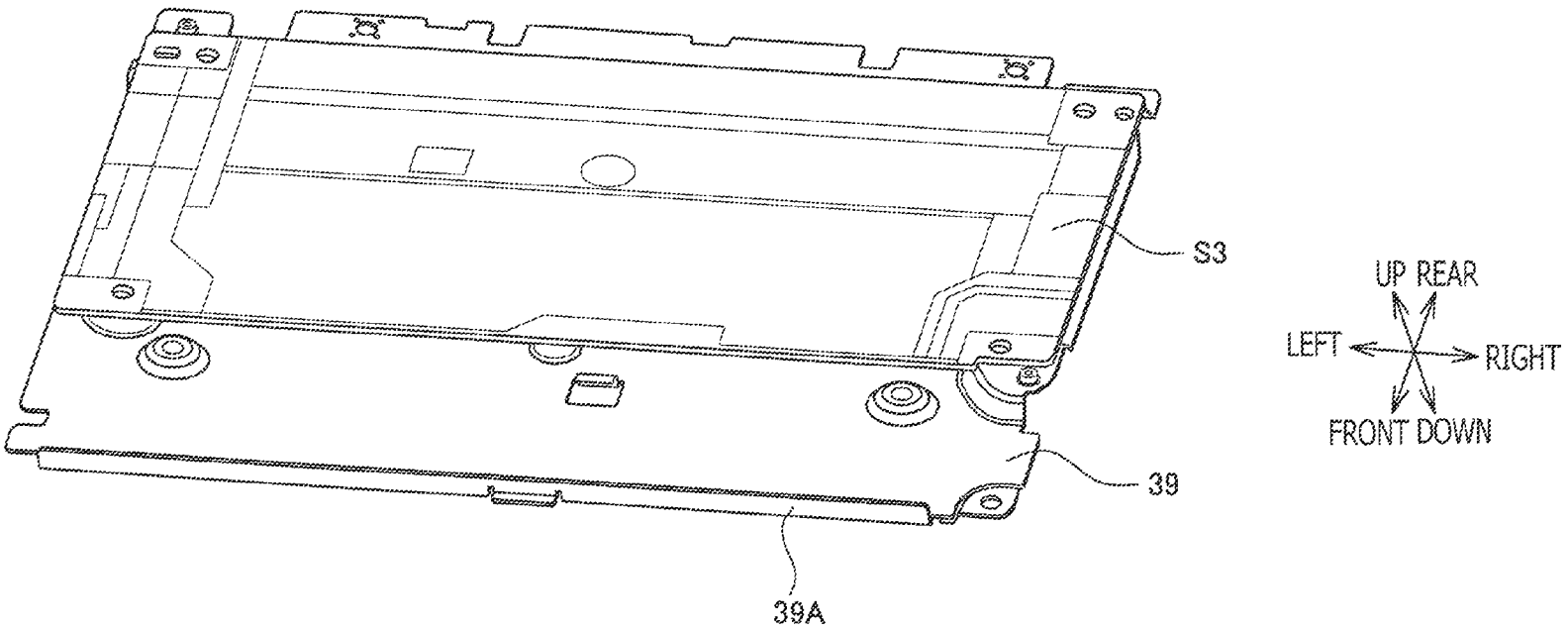
FIG. 9 is a perspective view showing a joint member and the low-voltage circuit board in the embodiment according to one or more aspects of the present invention.

As shown in FIG. 9, the joint member 39 is a plate-shaped member made of metal such as steel plate cold commercial (SPCC). In the embodiment, the joint member 39 is tightly attached to the two main frames 33 in a direct or indirect manner by a mechanical fastening method (e.g., by use of screws) (not shown).

The low-voltage circuit board S3, together with the joint member 39, is tightly attached to the two main frames 33 in a direct or indirect manner in a state where the low-voltage circuit board S3 is placed on an upper surface of the joint member 39. Therefore, a lower surface of the low-voltage circuit board S3 is covered with the joint member 39.

Figure 10:
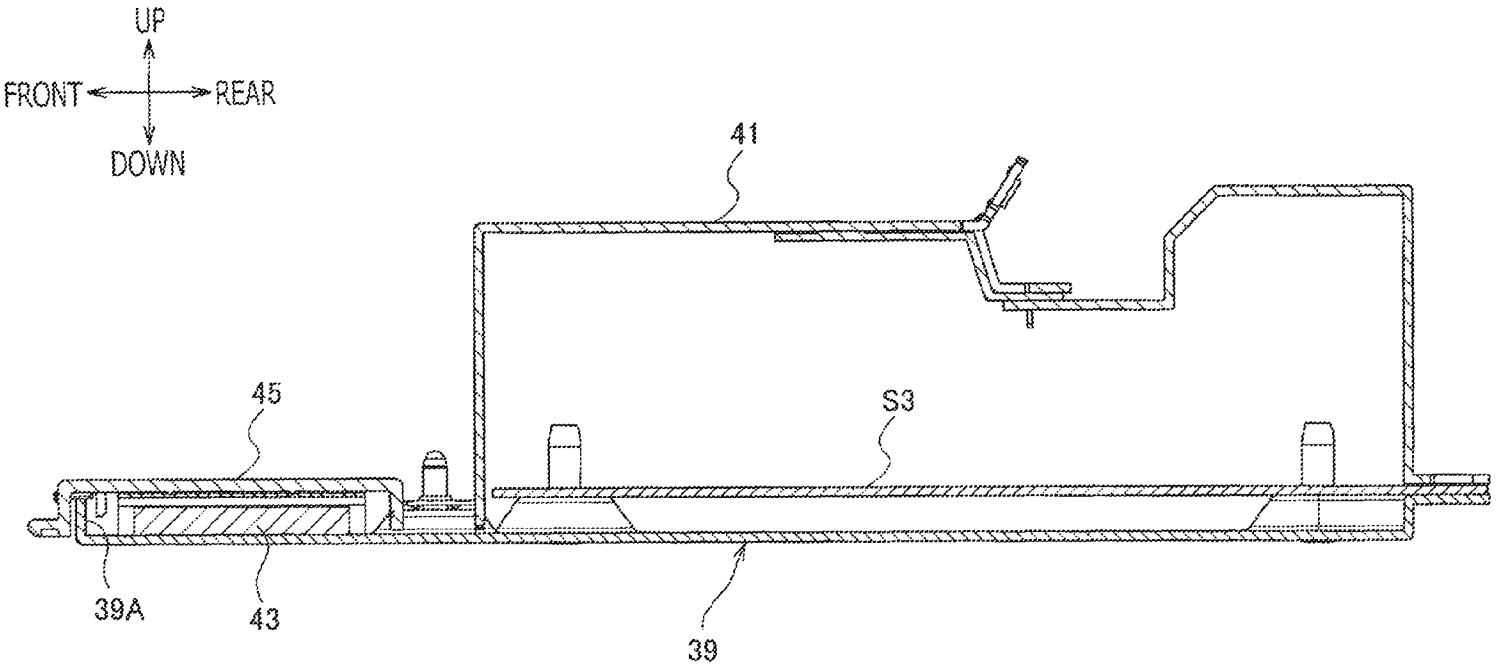
FIG. 10 is a cross-sectional side view showing a layout of elements such as the joint member and the low-voltage circuit board in the embodiment according to one or more aspects of the present invention.

As shown in FIG. 10, an upper surface of the low-voltage circuit board S3 is covered with a metal cover 41. The cover 41 is tightly attached to the joint member 39 by a mechanical fastening method (e.g., by use of screws) (not shown). The joint member 39 and the cover 41 are included in an enclosure configured to cover the low-voltage circuit board S3.

Further, the main electrical circuit board S1 is electrically connected with the high-voltage circuit board S5 via an electric wiring unit 43. As shown in FIG. 8, the electric wiring unit 43 horizontally extends to bridge the distance between the two main frames 33. In the embodiment, the electric wiring unit 43 is a flat flexible cable in which a plurality of cables are arranged in parallel and integrated.

Additionally, as shown in FIG. 10, the joint member 39 extends from a portion thereof that supports the low-voltage circuit board S3 (i.e., a portion thereof to which the cover 41 is attached) to the communication section 37B. The electric wiring unit 43 is supported from beneath by the joint member 39.

Therefore, a lower surface of the electric wiring unit 43 is covered with the joint member 39. Meanwhile, an upper surface of the electric wiring unit 43 is covered with a cover 45 attached to the joint member 39. It is noted that, in the embodiment, the cover 45 is made of resin.

Further, at an end, close to the communication section 37B, of the joint member 39, a protrusion 39A is formed to protrude from a plate surface of the plate-shaped joint member 39 and continuously extends so as to bridge the distance between the two main frames 33. The protrusion 39A is formed integrally with the joint member 39, as shown in FIG. 9. It is noted that, in the embodiment, the protrusion 39A is formed integrally with the joint member 39 in a process of pressing a steel plate and forming the joint member 39.

4. Features of Image Forming Apparatus

In the embodiment, when the plurality of photoconductive drums 7A and the belt device 29 are detached from the two main frames 33, the space for accommodating the plurality of photoconductive drums 7A is in communication with the sheet tray 17 via the communication section 37B.

Therefore, as shown in FIG. 11, by removing the plurality of photoconductive drums 7A and the belt device 29, the user is allowed to access the sheet tray 17 via the communication section 37B. Accordingly, for instance, when a sheet is jammed on a sheet feeding path extending from the sheet tray 17 to the transfer belt 21, by detaching the plurality of photoconductive drums 7A and the belt device 29, the user is allowed to easily remove the jammed sheet.

Further, in the embodiment, when the plurality of photoconductive drums 7A and the belt device 29 are detached, the communication section 37B exists, which leads from the space for accommodating the plurality of photoconductive drums 7A to the sheet tray 17 and allows the space for accommodating the plurality of photoconductive drums 7A to communicate with the sheet tray 17. Hence, it is possible to achieve a frame structure without any plate-shaped joint portion completely separating the space for accommodating the plurality of photoconductive drums 7A from the space for accommodating the sheet tray 17. Thus, according to the embodiment, it is possible to achieve the image forming apparatus 1 having a smaller size than a size of the known image forming apparatus.

Further, in the embodiment, the sheet tray 17 includes a part of the re-feeding path Lr configured to re-feed a sheet with an image completely formed on a first side thereof toward the transfer belt 21.

Thereby, in the embodiment, when the sheet tray 17 is removed, the re-feeding path Lr is partially exposed as shown in FIG. 12. Therefore, even when a sheet is jammed on the re-feeding path Lr, the user is allowed to access the re-feeding path Lr via the communication section 37B and easily remove the jammed sheet.

In the embodiment, the joint member 39 for connecting the two main frames 33 is disposed in the portion adjacent to the communication section 37B. Thereby, in the embodiment, it is possible to prevent the communication section 37B from becoming excessively reduced in size and to tightly connect the two main frames 33. Accordingly, it is possible to ensure the user-friendliness to allow the user to easily remove the jammed sheet and to enhance the stiffness of the frame structure.

In the embodiment, the joint member 39 forms a part of the enclosure for covering the low-voltage circuit board S3. Thereby, it is possible to protect the low-voltage circuit board S3.

In the embodiment, the joint member 39 is made of metal. Thereby, it is possible to certainly protect the low-voltage circuit board S3 and achieve high robustness of the frame structure.

Further, in the embodiment, since the joint member 39 has an additional role as a fire protection enclosure, it is possible to enhance the safety of the image forming apparatus 1. In the embodiment, the electric wiring unit 43 is provided to extend so as to bridge the distance between the two main frames 33, and at least a part of the electric wiring unit 43 is covered with the joint member 39. In the embodiment, since the joint member 39 is electrically connected to ground, it is possible to protect the electric wiring unit 43 from electrostatic troubles.

In the embodiment, the sheet tray 17 is detachably attached to a lower portion under the joint member 39. Therefore, when the sheet tray 17 is removed in an assumptive situation that the joint member 39 is not provided, the low-voltage circuit board S3 and the electric wiring unit 43 are bare in the space where the sheet tray 17 is attached.

On the contrary, in the embodiment, the low-voltage circuit board S3 is covered from beneath with the joint member 39. Therefore, even when the sheet tray 17 is removed, the low-voltage circuit board S3 is not put into a bare state.

In the embodiment, the joint member 39 is a plate-shaped member. Further, the protrusion 39A, which protrudes from the plate surface of the plate-shaped joint member 39, is formed at the end, close to the communication section 37B, of the joint member 39. Thereby, it is possible to enhance the stiffness of the joint member 39 and achieve high robustness of the frame structure.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, the plurality of exposure units 9 are provided for the plurality of photoconductive drums 7A, respectively. However, a scanning-type exposure unit may be employed, which is configured to scan light and expose the plurality of photoconductive drums 7A to the scanned light.

In the aforementioned embodiment, a direct transfer method is employed to directly transfer developer images onto a sheet being conveyed on the transfer belt 21. However, aspects of the present invention may be applied to an image forming apparatus employing an intermediate transfer method to transfer developer images onto the transfer belt 21 in a superimposed manner and transfer onto a sheet the developer images transferred onto the transfer belt 21.

In the aforementioned embodiment, the belt device 29 includes the belt cleaner 27, and the belt cleaner 27 and the belt unit 25 are detachably attached to the main frames 33 in a manner independent from one another. However, the belt device 29 may not include the belt cleaner 27. Alternatively, the belt device 29 may be provided with the belt cleaner 27 and the belt unit 25 unitized as a single unit.

In the aforementioned embodiment, the image forming apparatus 1 has the double-side printing function, and the sheet tray 17 includes a part of the re-feeding path Lr. However, the image forming apparatus 1 may only have the single-side printing function. Further, the re-feeding path Lr may be provided in a portion other than the sheet tray 17 (e.g., the re-feeding path Lr may be provided above the sheet tray 17).

In the aforementioned embodiment, the joint member 39 is made of metal. However, the joint member 39 may be made of resin. For instance, when the joint member 39 is made of flame-retardant resin such as PC/ABC, it is possible to make the joint member 39 serve as a fire protection enclosure, in the same manner as when the joint member 39 is made of metal.

In the aforementioned embodiment, the lower sides of the low-voltage circuit board S3 and the electric wiring unit 43 are covered with the joint member 39. However, the image forming apparatus 1 may be configured without the joint member 39. Alternatively, the low-voltage circuit board S3 and the electric wiring unit 43 may be disposed under the joint member 39, and may be supported by the joint member 39 as being hung from the joint member 39.

In the aforementioned embodiment, the image forming apparatus 1 is configured such that the user is allowed to attach or detach the process units 7 and the belt device 29 when the upper cover 3D is open. However, the image forming apparatus 1 may be configured such that the user is allowed to access, from a side, the process units 7 and the belt device 29 to attach or detach them.

What is claimed is:

1. An image forming apparatus comprising:

a plurality of photoconductive bodies arranged in tandem along a predetermined direction, each photoconductive body being configured to carry a developer image to be transferred onto a sheet;

a plurality of exposure units provided for the plurality of photoconductive bodies, respectively, each of the plurality of exposure units including an LED which emits light for exposing a corresponding one of the plurality of photoconductive bodies;

a belt device disposed under the plurality of photoconductive bodies and facing the plurality of photoconductive bodies, the belt device comprising:

an endless belt configured to move along a moving direction parallel to the predetermined direction;

a belt unit configured to hold the endless belt stretched tight; and a belt cleaner configured to clean contamination adhering onto the endless belt;

a sheet tray disposed under the belt device, the sheet tray being configured to receive placement of the sheet to be fed to the endless belt;

two main frames disposed to face each other across the plurality of photoconductive bodies, the plurality of exposure units, the belt device, and the sheet tray, the two main frames being configured such that the plurality of photoconductive bodies, the belt unit, the belt cleaner, and the sheet tray are detachably attached thereto, the two main frames being further configured to define a communication section under the endless belt, the communication section being configured to accommodate the belt cleaner and lead from a space for accommodating the plurality of photoconductive bodies to the sheet tray; and a joint member disposed under the endless belt and horizontally adjacent to the communication section configured to accommodate the belt cleaner, the joint member being a plate-shaped member made of metal, the joint member being configured to connect the two main frames with each other.

2. The image forming apparatus according to claim 1, further comprising a re-feeding guide configured to re-feed, toward the endless belt, the sheet of which image formation has been completed on one side, wherein the sheet tray includes a part of the re-feeding guide.

3. The image forming apparatus according to claim 1, wherein the joint member is further configured to form a part of an enclosure for covering an electrical board for the image forming apparatus.

4. The image forming apparatus according to claim 1, further comprising an electric wiring unit that extends to bridge a distance between the two main frames, wherein the joint member is further configured to cover at least a part of the electric wiring unit.

5. The image forming apparatus according to claim 1, wherein the joint member is formed in a plate shape, the joint member comprising a protrusion disposed at an end, close to the communication section, of the joint member and formed to protrude from a plate surface of the plate-shaped joint member.

6. The image forming apparatus according to claim 5, wherein the protrusion is formed integrally with the joint member.

7. The image forming apparatus according to claim 1, further comprising a cover disposed on an upper side of the two main frames, the cover being configured to swing around a swing axis disposed at an end of the image forming apparatus in the moving direction of the endless belt.

8. The image forming apparatus according to claim 1, further comprising a fuser unit disposed at an end of the image forming apparatus in the moving direction of the endless belt, the fuser unit being configured to fix the developer image transferred onto the sheet.

9. The image forming apparatus according to claim 7, further comprising a fuser unit disposed at the end of the image forming apparatus in the moving direction of the endless belt, the fuser unit being configured to fix the developer image transferred onto the sheet.

10. The image forming apparatus according to claim 1, wherein the communication section is configured to, when the plurality of photoconductive bodies and the belt device are detached from the two main frames, allow the space for accommodating the plurality of photoconductive bodies to communicate with the sheet tray, so as to allow an external access to the sheet tray via the communication section.

11. The image forming apparatus according to claim 1, wherein the belt unit and the belt cleaner are detachably attached to the two main frames in a manner independent from each other.

12. An image forming apparatus comprising:

a plurality of photoconductive bodies arranged in tandem along a first direction, each photoconductive body being configured to carry a developer image to be transferred onto a sheet;

a plurality of exposure units provided for the plurality of photoconductive bodies, respectively, each of the plurality of exposure units including an LED which emits light for exposing a corresponding one of the plurality of photoconductive bodies;

a belt device disposed under the plurality of photoconductive bodies and facing the plurality of photoconductive bodies, the belt device comprising:

an endless belt configured to move along the first direction, the belt device being disposed to face the plurality of photoconductive bodies;

a belt unit configured to hold the endless belt stretched tight; and a belt cleaner configured to clean contamination adhering onto the endless belt;

a sheet tray disposed under the belt device in a second direction perpendicular to the first direction, the sheet tray being configured to receive placement of one or more sheets to be fed to the endless belt;

two main frames disposed to face each other across the plurality of photoconductive bodies, the plurality of exposure units, the belt device, and the sheet tray in a third direction perpendicular to the first direction and the second direction, the two main frames being configured to allow the plurality of photoconductive bodies, the belt unit, the belt cleaner, and the sheet tray to be attached to and detached from the two main frames, the two main frames defining therebetween a communication section under the endless belt, the communication section configured to accommodate the belt cleaner and, when the plurality of photoconductive bodies and the belt device are detached from the two main frames, allow a space for accommodating the plurality of photoconductive bodies to communicate with the sheet tray, so as to permit external access to the sheet tray via the communication section; and a joint member disposed under the endless belt and horizontally adjacent to the communication section configured to accommodate the belt cleaner, the joint member being a plate-shaped member made of metal, the joint member being configured to connect the two main frames with each other.

* * * * *